US010591179B2

(12) United States Patent
Jefferson et al.

(10) Patent No.: US 10,591,179 B2
(45) Date of Patent: Mar. 17, 2020

(54) FLEXIBLE REGISTER BOOT FOR HEATED AND COOLED AIR

(71) Applicant: Ductmate Industries, Inc., East Monongahela, PA (US)

(72) Inventors: Alvin L. Jefferson, Pittsburgh, PA (US); Branden Butella, McKeesport, PA (US); David Agee, Finleyville, PA (US)

(73) Assignee: Ductmate Industries, Inc., East Monongahela, PA (US)

( * ) Notice: Subject to any disclaimer, the term of this patent is extended or adjusted under 35 U.S.C. 154(b) by 1389 days.

(21) Appl. No.: 13/965,304

(22) Filed: Aug. 13, 2013

(65) Prior Publication Data

US 2014/0049040 A1 Feb. 20, 2014

Related U.S. Application Data

(60) Provisional application No. 61/682,856, filed on Aug. 14, 2012.

(51) Int. Cl.
*F24F 13/02* (2006.01)

(52) U.S. Cl.
CPC ..... *F24F 13/0254* (2013.01); *Y10T 29/49623* (2015.01)

(58) Field of Classification Search
CPC ..... F24F 13/0218; F24F 13/0254; F24F 13/0245; F24F 13/0227; F24F 13/0272; F24F 13/084
USPC ..... 285/200, 213, 194, 260, 189, 193; 454/287, 292, 330, 331, 289
See application file for complete search history.

(56) References Cited

U.S. PATENT DOCUMENTS 2,308,310 A * 1/1943 Ruemelin, Jr. ..... B01D 46/02 285/189
2,509,782 A * 5/1950 Person, Jr. ..... B21C 37/28 285/189
2,543,909 A * 3/1951 Hatheway, Jr. ..... B65D 5/746 285/189
2,567,773 A * 9/1951 Krupp ..... F16L 37/025 285/260
2,722,170 A * 11/1955 Broberg ..... F24F 13/00 454/332
2,824,575 A * 2/1958 Rosen ..... F16L 37/084 285/260
2,841,418 A * 7/1958 Keating ..... F16L 5/00 285/194
2,910,308 A 10/1959 Carr
3,018,711 A * 1/1962 Wellington ..... B60H 1/244 285/260
3,053,564 A * 9/1962 Evans ..... B60J 5/04 285/189
3,151,905 A * 10/1964 Reuther ..... B60R 16/00 285/189

(Continued)

*Primary Examiner* — David Bochna
(74) *Attorney, Agent, or Firm* — The Webb Law Firm

(57) ABSTRACT

A register boot which has a duct opening at one end and a register opening at the other end that protrudes through a hole in a structure that is made of flexible material that is deformable and also restores itself to the natural shape of the register boot. Because the register boot is deformable it is able to pass through the hole in the structure. The register boot then restores itself to its original shape. The register boot as described allows for a method of installation that allows a single person to install the register boot.

12 Claims, 7 Drawing Sheets

(56) References Cited

U.S. PATENT DOCUMENTS 3,703,194 A * 11/1972 Giordano ..... E04D 13/0641 285/194
3,892,169 A * 7/1975 Jarnot ..... B60H 1/26 135/117
4,015,961 A * 4/1977 Howard ..... B01D 46/02 285/189
4,050,363 A * 9/1977 Fuerst ..... B60H 1/30 29/453
4,058,261 A * 11/1977 Pollart ..... B05B 1/14 239/542
4,073,632 A * 2/1978 Reinauer ..... B01D 46/0004 55/302
4,249,758 A * 2/1981 Harris ..... F16L 41/086 285/136.1
4,291,904 A * 9/1981 Iversen ..... B01D 46/02 285/140.1
4,318,337 A * 3/1982 Wichmann ..... B08B 15/002 454/65
4,365,829 A * 12/1982 Fowler ..... F16L 41/088 285/140.1
D268,282 S * 3/1983 Wichmann ..... D23/393
4,438,960 A 3/1984 Carroll et al.
4,750,411 A 6/1988 Eversole
4,909,566 A 3/1990 Hashimoto et al.
4,995,648 A 2/1991 Jackson
5,080,403 A * 1/1992 Paoluccio ..... F16L 41/00 285/189
5,087,084 A 2/1992 Gehring
5,095,942 A 3/1992 Murphy
5,145,216 A * 9/1992 Valls, Jr. ..... F16L 41/088 285/140.1
5,219,403 A 6/1993 Murphy
5,240,288 A * 8/1993 Inda ..... F16L 41/025 138/109
5,588,908 A * 12/1996 Camarota ..... B60H 1/00564 285/189
5,678,953 A 10/1997 Usui et al.
5,755,463 A 5/1998 Davidson
5,957,506 A 9/1999 Stepp
6,173,997 B1 1/2001 Nordstrom et al.
6,231,704 B1 5/2001 Carpinetti
6,273,145 B1 * 8/2001 Botting ..... F24F 13/02 138/156
6,303,869 B1 * 10/2001 Shanahan ..... B60R 16/0215 138/109
6,460,896 B1 * 10/2002 Stephens ..... E03F 3/04 285/136.1
6,652,375 B2 * 11/2003 Donnelly ..... F24F 13/072 454/289
6,866,579 B2 * 3/2005 Pilger ..... F24F 13/02 454/292
6,884,159 B1 4/2005 Ferraud, Jr.
6,908,115 B2 * 6/2005 Synder ..... F24F 13/084 285/189
7,032,368 B2 4/2006 Funk et al.
7,059,638 B2 * 6/2006 Charrette ..... F16L 41/088 285/189
7,232,370 B1 6/2007 Newell
7,328,478 B2 * 2/2008 Jenkins ..... A47L 5/38 15/301
7,410,416 B2 8/2008 Fettkether
7,488,010 B2 2/2009 Wellman et al.
7,645,189 B2 * 1/2010 Pilger ..... F24F 13/02 248/57
7,771,259 B2 8/2010 Pettit
7,959,190 B2 * 6/2011 McPheat ..... B65G 53/52 285/260
7,966,857 B1 * 6/2011 Myers ..... B21D 22/20 29/890.141
7,992,903 B1 8/2011 Desimone
8,485,561 B2 7/2013 Guo
8,628,605 B2 * 1/2014 Doehla ..... B01D 46/0068 55/378
2002/0125721 A1 9/2002 Imaeda et al.
2003/0051764 A1 3/2003 Jungers
2008/0318514 A1 * 12/2008 Fettkether ..... F24F 13/0218 454/330
2013/0180204 A1 7/2013 Metz et al.

* cited by examiner

FLEXIBLE REGISTER BOOT FOR HEATED AND COOLED AIR

CROSS-REFERENCE TO RELATED APPLICATIONS

This application claims the benefit of U.S. Provisional Application No. 61/682,856, filed Aug. 14, 2012 which is hereby incorporated by reference in its entirety.

BACKGROUND

In heating and air conditioning systems, heated or cooled air is delivered to registers in the various rooms of the building to be circulated in the rooms. Additionally, air is returned from the rooms to the heating or cooling unit. Currently, the heated or cooled air is transmitted from the main line of the heating and cooling unit to the registers through sheet metal conducts that are both inefficient for conducting the air and difficult to install. Air can also be returned via separate registers located within a structure. With these prior constructions, installation of a sheet metal register boot was typically a two-man job since the boot had to be nailed in place by one man as it was positioned from the other side of the floor or wall by another man. Additionally, the prior art register boots were made of multi-piece sheet metal construction having sharp angles and created a rigid structure. The multi-piece construction causes a source of air leakage from the boot along the seams and transverse seams also can restrict air flow. The sharp angles restrict flow of air through the boot register.

After the sheet metal register boot was installed, the various angled connections of the boot made it difficult to seal and the passage of air through the boot was inefficient because of the various angles in the interior wall of the connecting passage and because the various joints of the elbow forming the boot had to be separately sealed at an additional cost of labor. The modern building codes require the heating and cooling systems to be sealed to promote the efficiency of the units. The typical means of sealing register boot was painting the register boot or applying liquid sealant during installation. This step adds time to the installer's job and increases costs of installation.

The use of sheet metal register boots also increases the noise from the HVAC system. The sheet metal register boot expands, contracts and vibrates as air is conveyed through it. The sheet metal boot is typically nailed directly to the structure.

The present invention provides a boot that is more efficient for installation and is also more efficient for conveying air since it has a smooth, gradually transitioned surface for passage of air to or from the register. The present invention, being formed of flexible material such as rubber helps to isolate noise and vibrations in the heating/cooling systems from the structure of the building. When the boot is installed, it is self-sealing to both the duct and to the floor or wall of the building which will house a register.

BRIEF SUMMARY OF THE INVENTION

The present invention provides a flexible register boot for conducting air from a furnace or air conditioning unit to a register location within a structure or from a register location within a structure to an air conditioning unit or furnace. The boot has a duct opening that can have a circular cross-section at one end of the boot that attaches to a duct and a register opening that can have a rectangular cross-section at the other end of the boot that protrudes through a hole in the structure, which can be a floor or wall of a residential housing unit. The register boot is formed of flexible material such as an elastomeric polymer such as rubber that is sufficiently deformable to pass either end of the boot through the hole in the structure. The hole can be a rectangular opening in the floor or wall of a residential unit. The boot after it is deformed can thereafter be restored to its natural shape to seal the boot to the floor or wall. By "self-sealing" we mean the boot will form a seal by tightly fitting around the edges of the hole, the flanges or other attachment mechanism that locks and seals the register opening to the hold in the structure.

The flexible boot is molded of rubber or like material and is fully sealed. The interior is a smooth passage having no obstructions or rough weld surfaces, and the contours of the boot, when molded, promote the smooth passage of air. The boot is an aerodynamic design in that it has no sharp angles and instead has a smooth curvature to reduce turbulence and improve air flow. This lowers the pressure drop through the boot and thus requires less energy to move a given amount of air through it as compared with the prior art sheet metal boots.

Because of the flexibility, either end of the boot can be distorted to insert it through a hole. The flange arrangement on the boot can accommodate it to various types of flooring or wall construction. The flange can be adjustable having a tapered flange and/or different tapered notches spaced apart by ⅛ inch or other amount or a slideable bottom flange. Typically, the spacing of the flanges will be designed to accommodate between ¼ of inch and 1 inch. The adjustability of a sliding bottom flange could be infinite but typically would be from 1/16 of inch to 4 inches. Most importantly, the labor required to install the boot of the present invention is substantially reduced, because of the flexible nature of the boot, the method of installation of the boot is novel and only requires one person to install the boot.

DETAILED DESCRIPTION

Figure 1:
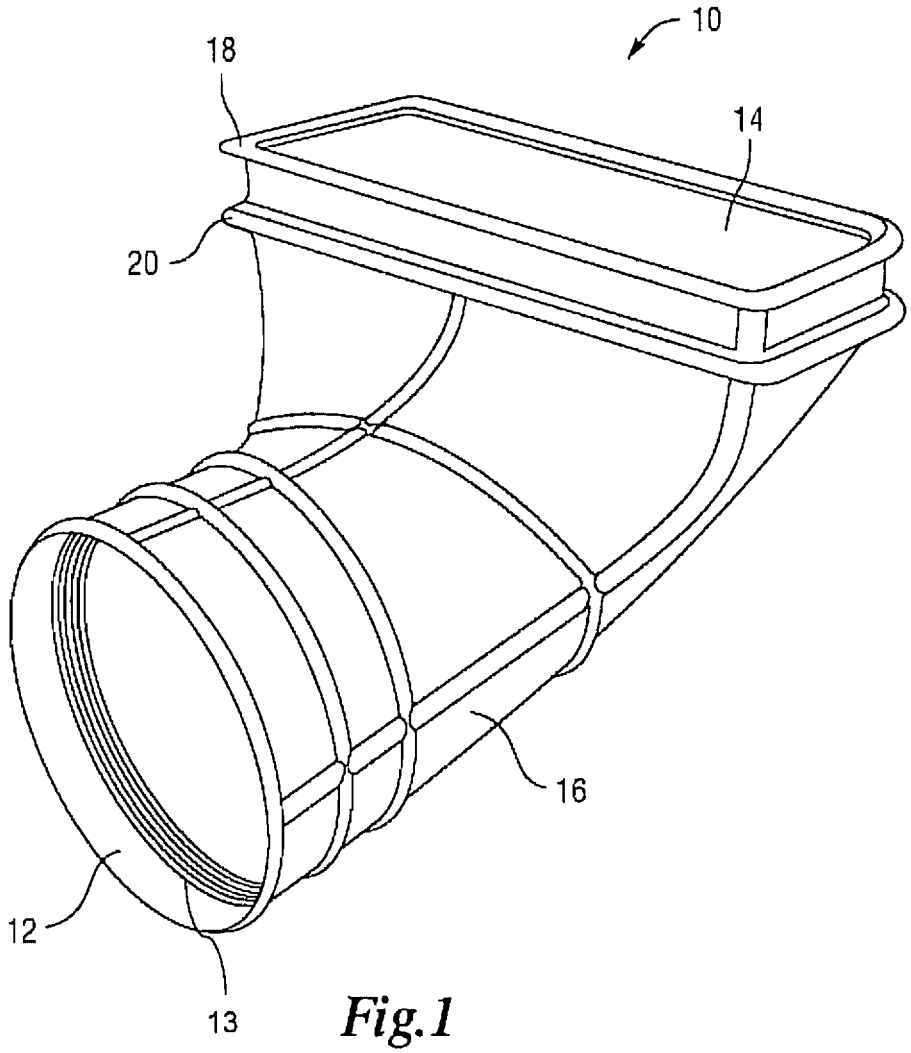
FIG. 1 is a perspective view of a flexible boot of the present invention with rectangular opening oriented in a direction perpendicular to the boot.
Figure 2:
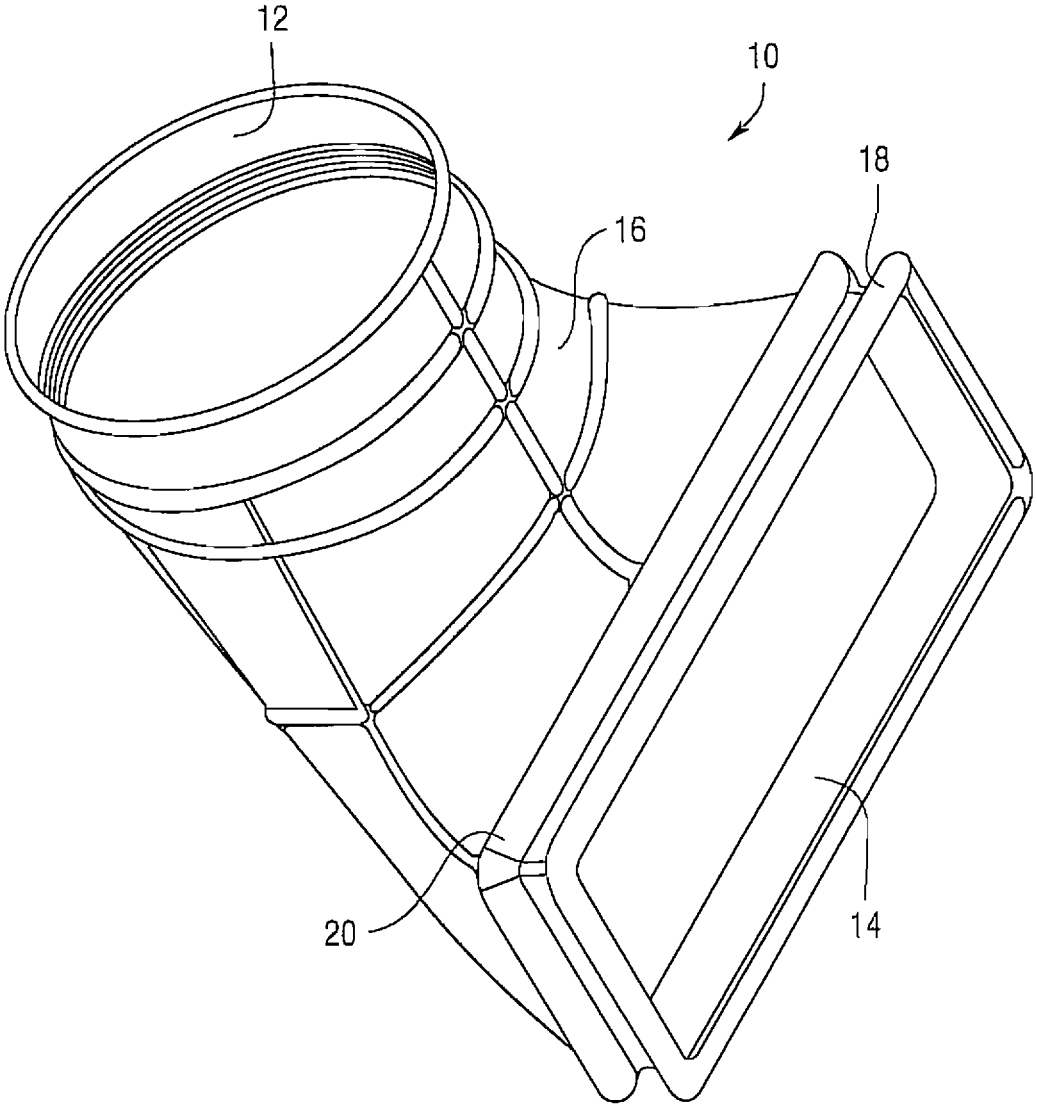
FIG. 2 is a view similar to FIG. 1 with a boot that is designed to be attached to the end of a circular pipe.

Referring to FIGS. 1 and 2, there is shown a flexible register boot 10 having a duct opening end 12 that is circular in this embodiment and a register opening end 14 that is rectangular in this embodiment. The duct opening end 12 could have other shapes such as rectangular. The register opening end 14 could have other shapes such as circular. The duct end 12 is arranged for sealing attachment 13 to a circular pipe (not shown) that delivers conditioned air to the boot 10. The sealing attachment 13 is a gasket type formation that can interact with the male end of the duct. The male end of the duct can have an indentation, fold or bead that interacts with the sealing attachment 13 to create an air tight seal. Some examples of sealing mechanisms can be seen in U.S. Pat. Nos. 7,992,904 and 8,429,803, both to Gudenburr, the teachings of which are both hereby incorporated by reference in their entireties. The sealing attachment 13 can be made to be used with Ductmate's GreenSeam®+ snap lock pipe. The register opening end 14 is designed to enter and be installed into a hole in a structure. The structure is typically the floor or wall of a building structure such as a residential home.

The body 16 of boot 10 is designed to provide a smooth flow of air from circular end 12, through body 16 to rectangular end 14. As can be seen, there are no sharp angles and the inside is free of seams in order to reduce turbulence and improve air flow through the boot 10. The entire boot 10 is molded from a flexible material such as rubber that can be distorted so that either duct opening end 12 or the register opening end 14 can be forced through a corresponding hole in a floor or wall to the extent that outer flange 18 is within the room in which the hole in structure which can be the floor or wall and is formed and inner flange 20 remains outside the hole on the internal side of the structure. The flexible material can be any type of elastomeric polymer. The elastomeric polymer should be flexible enough so that it can be deformed to fit through a hole and then be able to restore itself to its original shape. The two flanges 18 and 20 sealingly secure the flexible register boot 10 within the floor or wall when the boot 10 that has been deformed to position it within the register hole returns to its natural state. A typical floor is ¾ of inch. Preferably, the flanges are spaced between ¼ of an inch and 1 inch to accommodate for different thicknesses. As shown in FIG. 6C, inner flange 20 can be tapered to accommodate for different structure thicknesses. Additionally, the flange structure could include multiple tapered notch flanges spaced apart to accommodate for the different spacing needed for different structures with each notch used for a different thickness (not shown). The notches could be spaced ⅛ inch or smaller apart. In another embodiment (not shown), the inner flange 20 could be adjustable. The inner flange 20 would be slideably connected to the boot 10 so that it could slide toward the structure and lock so that the boot 10 is sealed to the structure between outer flange 18 and inner flange 20. Outer flange 20 can also be tapered as show in FIG. 6B.

Figure 3:
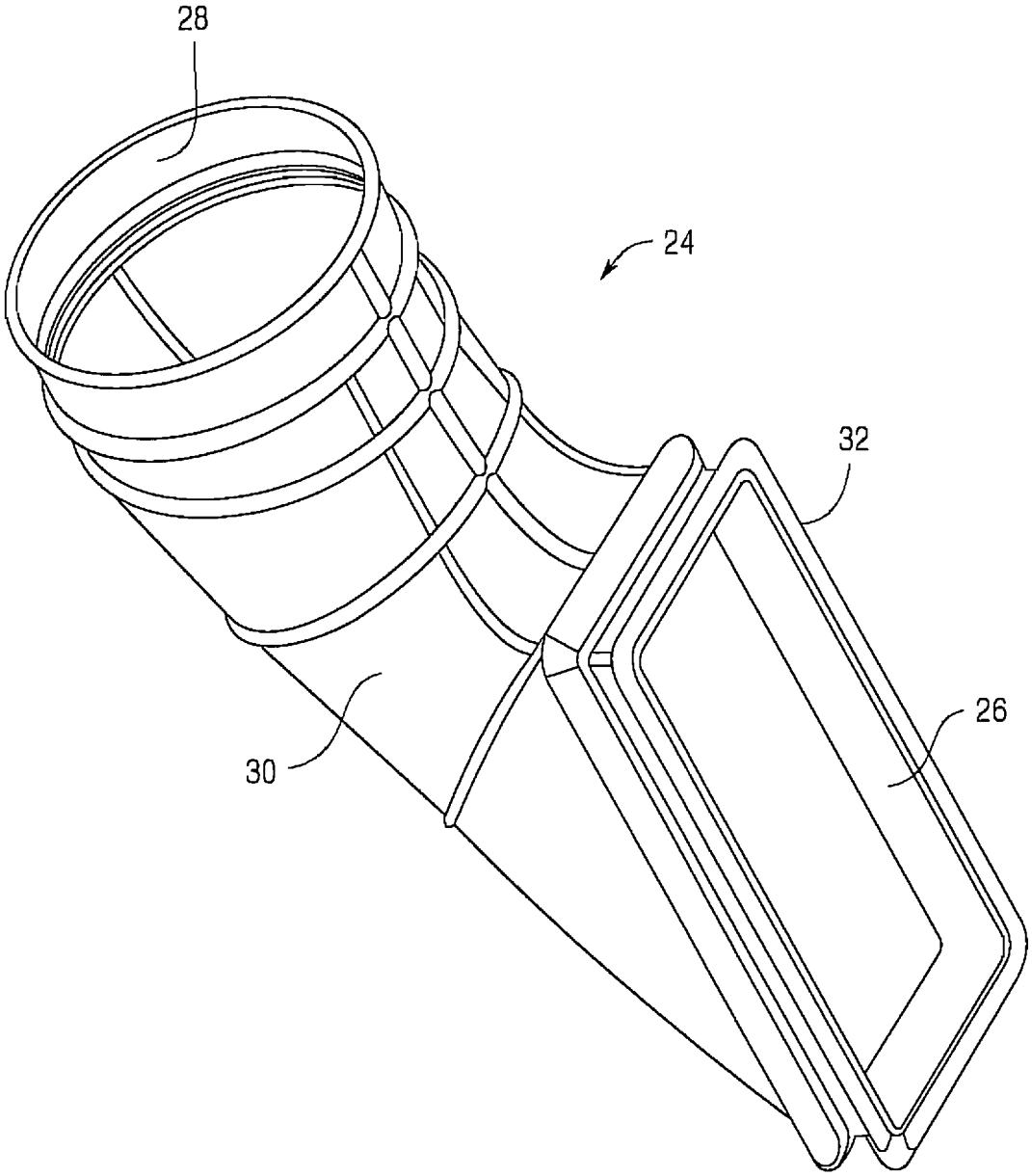
FIG. 3 is a view similar to FIGS. 1 and 2, but with the rectangular opening oriented longitudinally relative to the boot.

FIG. 3 shows another embodiment of a flexible register boot 24 that has a rectangular end 26. The rectangular end 26 of boot 24 is oriented in a direction parallel to boot body 30 whereas in FIGS. 1 and 2, the rectangular end 14 is oriented perpendicularly to boot body 16. The circular end 28 receives a circular pipe (not shown) and the outer flange 32 and the inner flange 34 (in FIG. 3) are positioned on each side of the register hole in the floor or wall as described in connection with the boot 10.

The heavy dark lines in FIGS. 2 and 3 between the circular end and the register end of boot 24 can be part of the invention depending on the thickness of the material, but would only be on the outside to provide rigidity. When they are not part of the invention, they are shown only to further demonstrate the contours of boot bodies 16 and 30, respectively, that provide a smooth air passage through the respective boots 10 and 24.

Figure 4A:
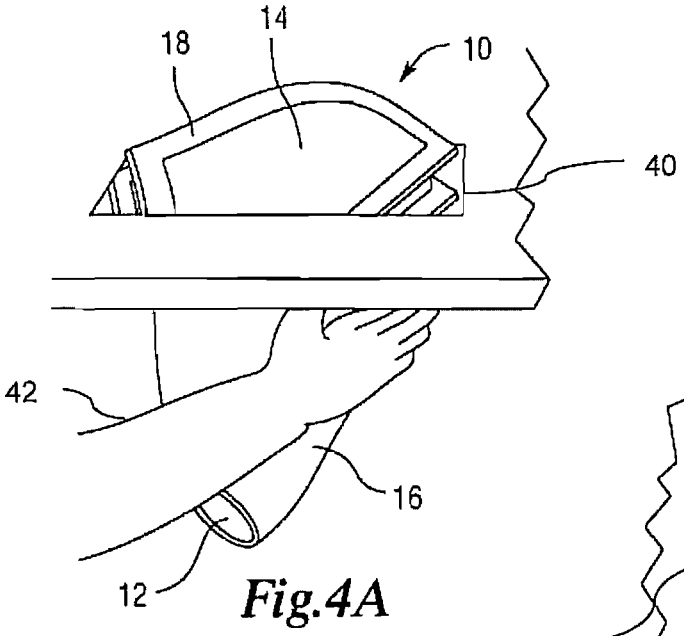
FIGS. 4A-C show the flexible register boot being installed by being deformed so that it is inserted into and through the hole and then restored to its natural shape to form a self sealing register boot.
Figure 4B:
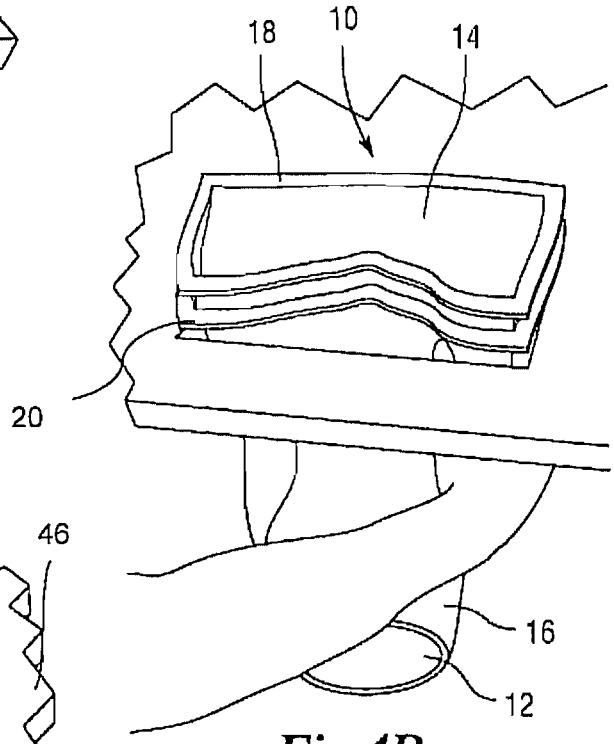
Figure 4C:
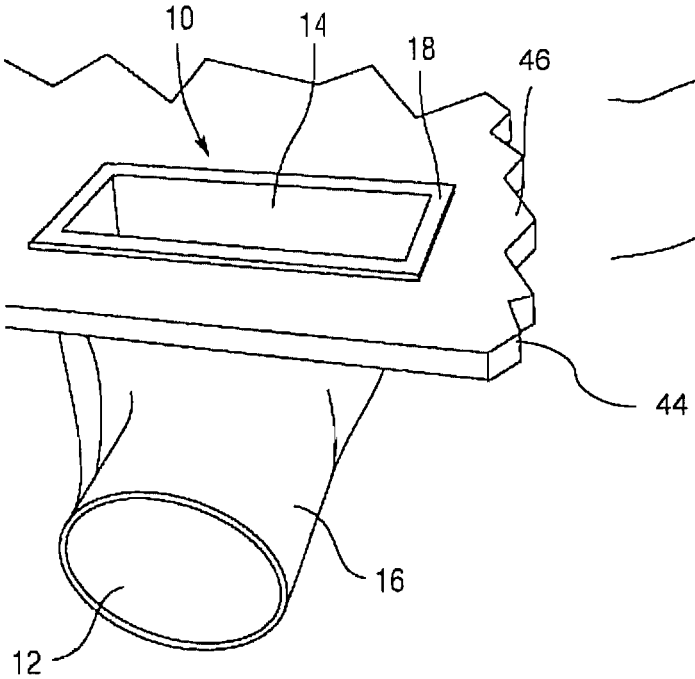
Figure 5A:
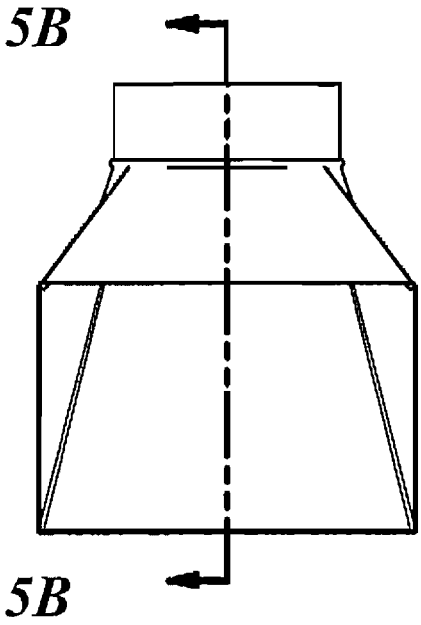
FIGS. 5A-5D show the prior art sheet metal register boot having multiple seams and sharp angles.
Figure 5B:
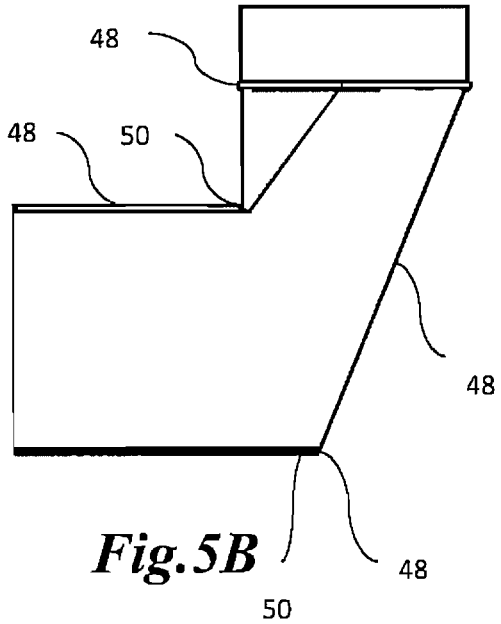
Figure 5C:
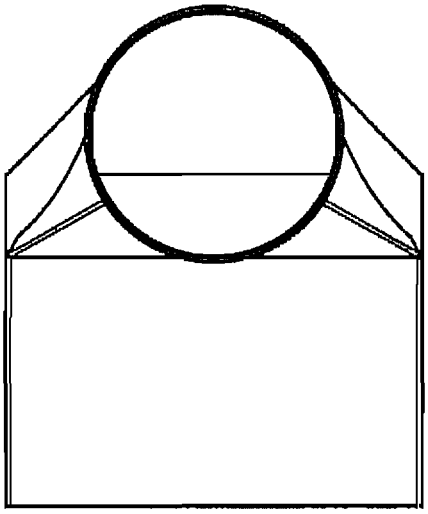
Figure 5D:
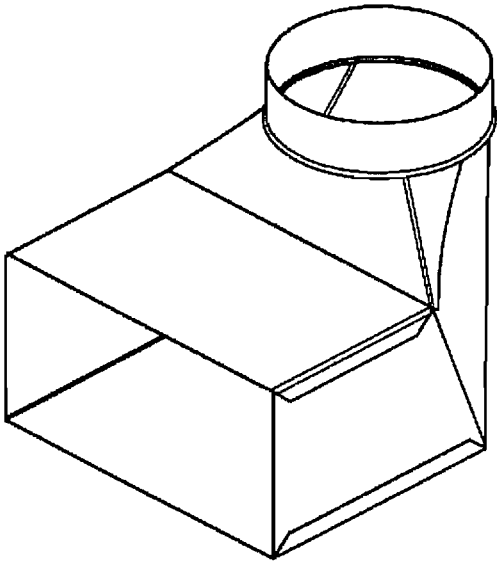
Fig.5D (Prior Art)

FIGS. 4A-4C show the flexible register boot being installed by being deformed so that it is inserted into and through the hole 40 and then restored to its natural shape to form a self sealing register boot. As can be seen, a single installer 42 can install this boot into the hole 40 in the structure 44. The person is able to deform the register boot 10 so that it can be inserted into and through the hole 40. Outer flange 18 is then pulled down so that it seats on an outside surface 46 of the structure 44 and seals to the exposed outside surface 46, while inner flange 20 seats to an inner surface of the structure 44.

FIGS. 5A-5D show the prior art sheet metal register boot having multiple seams 48 and sharp angles 50 (all angles and all seams not marked). Typically when this boot is installed one installer has to hold the boot in the hole from the bottom or inside when a second installer has to go to the top or outside and nail the boot to the hole. Additional steps are then required to seal the boot. A smooth curvature can be one that allows for increased air flow over the prior register boot shown in FIGS. 5A-5D.

Figure 6A:
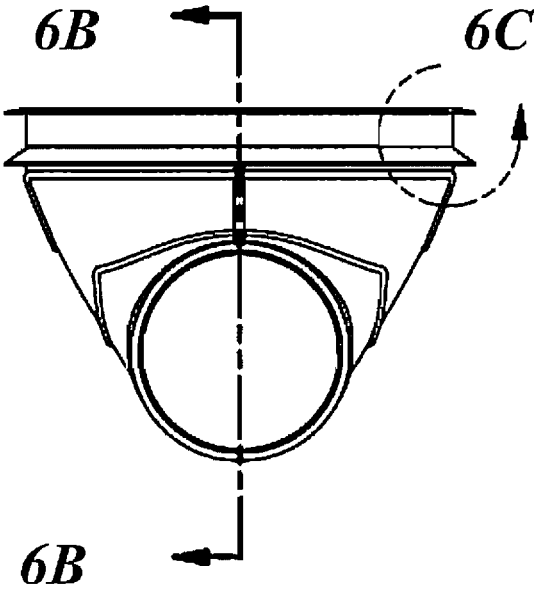
FIGS. 6A-6C show the flexible register boot having beveled edges and the lower edge having significant bevel to account for different opening thicknesses.
Figure 6C:
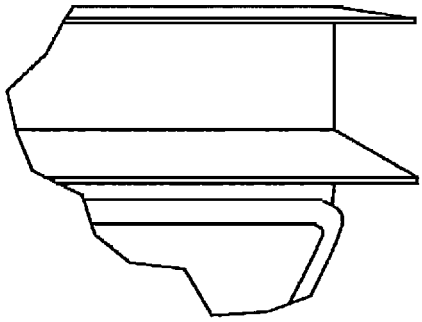
Figure 6B:
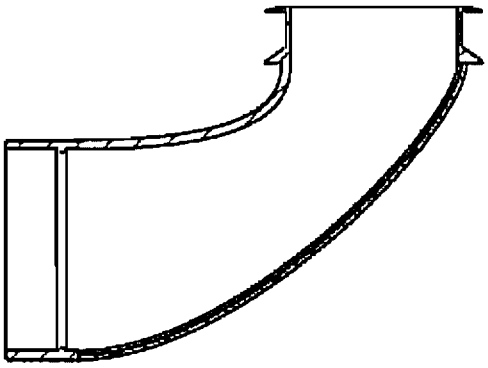
Figure 7A:
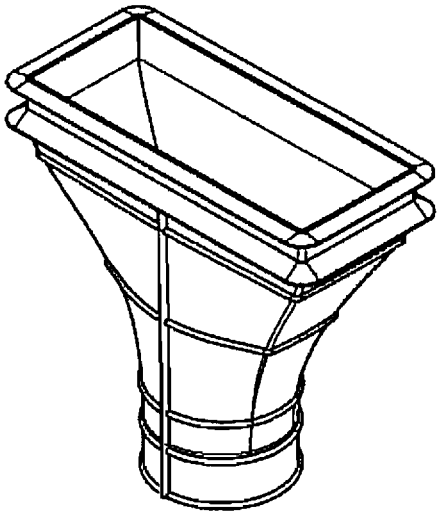
FIGS. 7A-7D show an alternate straight register boot.
Figure 7D:
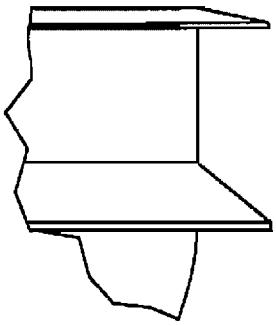
Figure 7B:
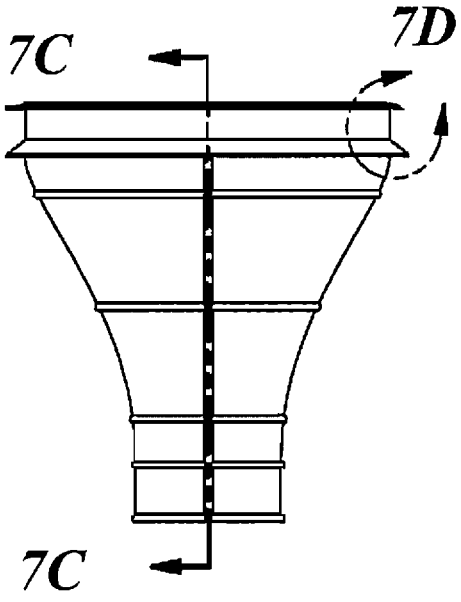
Figure 7C:
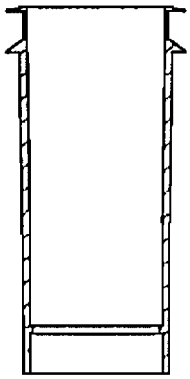

FIGS. 6A-6C show the flexible register boot having beveled edges and the lower edge having significant bevel to account for different opening thicknesses.

FIGS. 7A-7D show an alternate straight register boot.

The following tables show the improved air flow through a duct system having the flexible register boot as claimed and described versus the prior art sheet metal boot. It should be noted that the register boot was also connected with an improved take off as shown in Provisional Application Ser. No. 61/682,938, filed Aug. 14, 2012, so that the improvement is combined improvement. The measure is air flow through the prior art system shown in Table A. In Table B, the prior art register boot was replaced with register boot claimed and described. Additionally, the take off was replaced with a take off as claimed and described in Provisional Application Ser. No. 61/682,938.

TABLE A

| Prior Art | | | |
|---|---|---|---|
| Target FPM | | Actual FPM | CFM |
| 2 × 4 Duct | 360 | 370.8 | 103.0824 |
| 6" Pipe | 507 | 560 | |
| Trk Duct | | 1214.3 | 1517.875 |

TABLE B

| New | | | |
|---|---|---|---|
| Target FPM | | Actual FPM | CFM |
| 2 × 4 Duct | 360 | 419.6 | 116.6488 |
| 6" Pipe | 507 | 608 | 119.32 |
| Trk Duct | | 1153.4 | 1441.75 |

Various changes could be made in the above constructions and method without departing from the scope of the invention as defined in the claims below. It is intended that all matter contained in the above description, as shown in the accompanying drawings, shall be interpreted as illustrative and not limiting.

10 flexible register boot
12 duct opening of 10
13 sealing attachment
14 register opening end
16 boot body

18 outer flange
20 inner flange
24 flexible boot
26 rectangular end of 24
28 circular end of 24
30 boot body
32 outer flange
34 inner flange
40 hole
42 single installer
44 structure
46 outside surface
48 seams
50 sharp angles

I claim:

1. A register boot comprising:

(a) an end to connect to ductwork that provides a flow of air;

(b) a second end that fits within a wall, floor, or ceiling to provide air to a room;

(c) a body between the two ends; and (d) wherein the end, second end and body form the register boot and are made of a flexible resilient material.

2. The register boot as recited in claim 1 wherein the register boot is self sealing.

3. The register boot as recited in claim 1 wherein the body has smooth contours that reduce turbulence and improve airflow and has no sharp angles.

4. The register boot as recited in claim 1 wherein the register boot is a one piece structure.

5. The register boot as recited in claim 1 wherein the register boot does not have a seam or a joint that is transverse to the direction of the air flow.

6. The register boot as recited in claim 1 wherein the register boot is a two piece structure joined or welded together longitudinally.

7. The register boot as recited in claim 1 wherein the register boot provides for more efficient air flow than a prior art sheet metal boot.

8. The register boot as recited in claim 1 wherein the register boot is manufactured as a sealed boot that does not require any sealing from the installer.

9. The register boot as recited in claim 1 wherein the second end has a mechanism so that installation to the floor, wall or ceiling is sealed without the installer applying sealant.

10. The register boot as recited in claim 1 wherein the end has a mechanism so that the connection with the ductwork is self sealing.

11. The boot register of claim 1 wherein vibration of the register boot is reduced.

12. The boot register of claim 1 wherein the register boot reduces noise of a HVAC system.

* * * * *